US005308938A

United States Patent [19]

Roberts et al.

[11] Patent Number: 5,308,938

[45] Date of Patent: May 3, 1994

[54] ELEVATOR ACTIVE SUSPENSION SYSTEM

[75] Inventors: Randall K. Roberts; Richard L. Hollowell, both of Amston; Clement A. Skalski, Avon; John K. Salmon, South Windsor, all of Conn.

[73] Assignee: Otis Elevator Company, Farmington, Conn.

[21] Appl. No.: 555,132

[22] Filed: Jul. 18, 1990

[51] Int. Cl.[5] ..... B66B 1/44

[52] U.S. Cl. ..... 187/115; 187/1 R

[58] Field of Search ..... 310/19, 90.6; 74/8 R; 187/1 R, 95, 109, 134, 115, 1 R, 95

[56] References Cited

U.S. PATENT DOCUMENTS

| | | | |
|---|---|---|---|
| 3099334 | 7/1963 | Tucken, et al. | 187/95 |
| 3669222 | 6/1972 | Takamura, et al. | 187/95 |
| 3,939,778 | 2/1976 | Ross et al. | 105/182.1 |
| 4,167,296 | 9/1979 | Denoy | 74/5 R |
| 4,215,403 | 7/1980 | Pollard et al. | 364/424 |
| 4,621,833 | 11/1986 | Soltis | 280/707 |
| 4,625,993 | 12/1986 | Williams et al. | 280/707 |
| 4,750,590 | 6/1988 | Otala | 187/95 |
| 4,770,438 | 9/1988 | Sugasawa et al. | 280/707 |
| 4,809,179 | 2/1989 | Klinger et al. | 364/424.05 |
| 4,849,666 | 7/1989 | Hoag | 310/90.5 |
| 4,882,512 | 11/1989 | Andrus | 310/90.5 |
| 4,892,328 | 1/1990 | Kurtzman et al. | 280/707 |
| 4,898,257 | 2/1990 | Brandstadter | 180/9.1 |
| 4,899,852 | 2/1990 | Salmon et al. | 187/1 R |
| 4,909,535 | 3/1990 | Clark et al. | 280/707 |
| 4,912,343 | 3/1990 | Stuart | 310/14 |
| 5,020,639 | 6/1991 | Michel | 187/1 R |
| 5,086,882 | 2/1992 | Sugahara et al. | 187/95 |

FOREIGN PATENT DOCUMENTS

| | | | |
|---|---|---|---|
| 0033184 | 8/1981 | European Pat. Off. | B66B 7/04 |
| 0467673 | 1/1992 | European Pat. Off. | B66B 11/02 |
| 61-22675 | 11/1980 | Japan | B66B 7/08 |
| 60-15374 | 7/1983 | Japan | B66B 1/06 |
| 60-36279 | 8/1983 | Japan | B66B 7/04 |
| 58-39753 | 9/1983 | Japan | B66B 7/02 |
| 63-45768 | 9/1986 | Japan | B66B 13/06 |
| 63-87483 | 9/1986 | Japan | B66B 1/06 |
| 1-156293 | 12/1987 | Japan | B66B 11/02 |
| 1-197294 | 2/1988 | Japan | B66B 7/04 |
| 1-288591 | 5/1988 | Japan | B66B 11/08 |
| 2-3891 | 6/1988 | Japan | G08B 17/107 |
| 2-127373 | 11/1988 | Japan | B66B 1/26 |
| 2-198997 | 1/1989 | Japan | B66B 11/08 |
| 3-88687 | 4/1991 | Japan | B66B 7/04 |
| 3-88690 | 4/1991 | Japan | B66B 11.02 |
| 2238404 | 5/1991 | United Kingdom | B66B 7/02 |

OTHER PUBLICATIONS 3-88690(A) Abstracts of Japan-JAPIO-"Riding Cage for Elevator"-based on Appl. No. 64-224438 filed Sep. 1, 1989.

(List continued on next page.)

*Primary Examiner*—Steven L. Stephan
*Assistant Examiner*—Robert Nappi
*Attorney, Agent, or Firm*—Francis J. Maguire, Jr.

[57] ABSTRACT

A method and apparatus for actively counteracting a disturbing force acting on a suspended elevator cab moving vertically in a hoistway is disclosed. A manifestation of the disturbing force such as acceleration is sensed and counteracted, for example, by effectively exerting counterforces against the cab. The magnitude and phase of the counterforce is selected according to the magnitude and phase of the system response to a disturbing force. The invention may be carried out using an electromagnet actuator for actuating the suspended cab in response to a control signal from a control means which is in turn responsive to the sensed signal. The control means may be analog or digital or a combination of both. A preferred analog-digital approach is disclosed in which the digital part is responsive to accelerometer signals, the analog part is responsive to a force command signal from the digital part and provides a force feedback signal for comparison to the force command signal. In a pendulum car embodiment, three pairs of electromagnets form three actuators situated between the floor of the frame and the bottom of the suspended cab.

37 Claims, 12 Drawing Sheets

OTHER PUBLICATIONS 3-88687(A) Abstracts of Japan-JAPIO-"Elevator Device" -based on Appl. No. 64-221487 filed Aug. 30, 1989.

Operational Amplifier Charcteristics and Applications 1987 pp. 112 to 114 Section 5.2.2 The Low-Pass RC Filter Section.

"Inertial Profilometer as a Rail Surface Measuring Instrument", T. J. Rudd et al, pp. 1-9.

"Development of an Inertial Profilometer", E. L. Brandenburg et al, Publication No. PB-239 464, National Technical Information Service, U.S. Department of Commerce, pp. 1-37.

Skalski, C. A. "Performance of Magnetic Suspensions for High Speed Vehicles Operating over Flexible Guideways" Jun. 1974 *Journal of Dynamic Systems, Meas. & Control.*

"A Magnetic Bearing Control Approach Using Flux Feedback" by N. Groom, published Mar. 1989 in *NASA Technical Memorandum 100672.*

*NASA Tech Briefs*, "Flux-Feedback Magnetic-Suspension Actuator" publ. Jul. 1990, pp. 44-45.

*Popular Science*, Sep. 1990 "Riding on Electrons" by Don Sherman pp. 74-77.

FIG.8
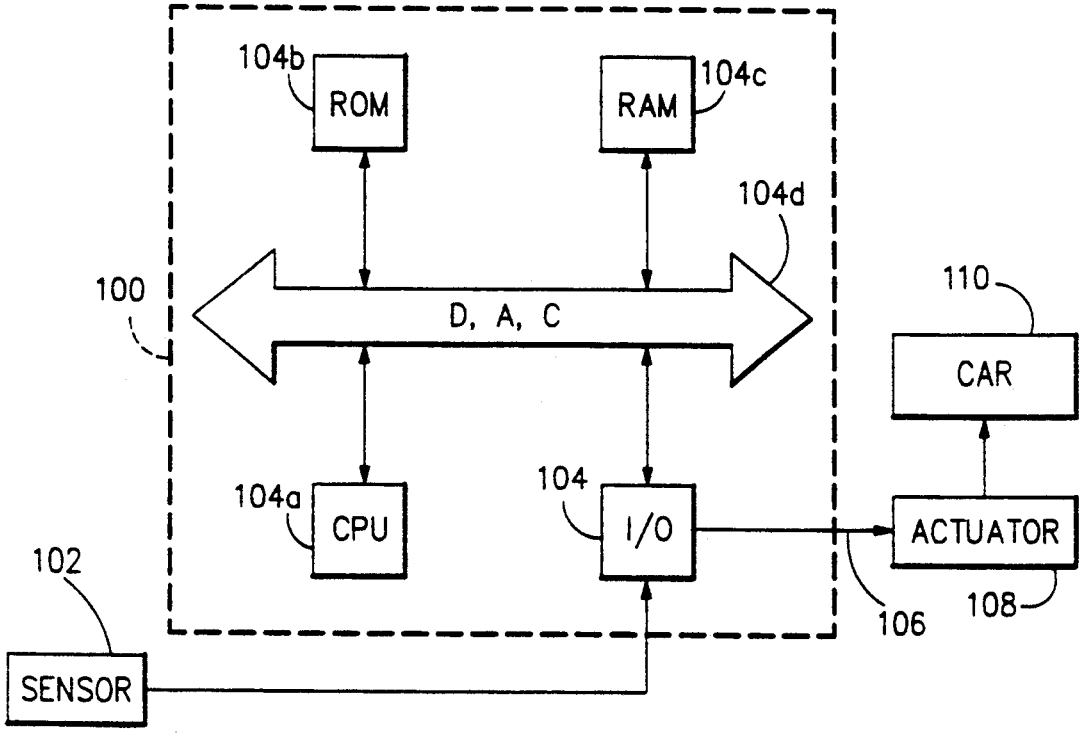
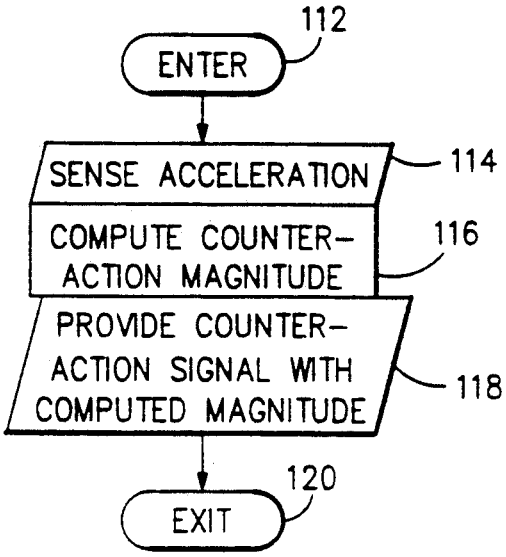
FIG.9

FIG.11A
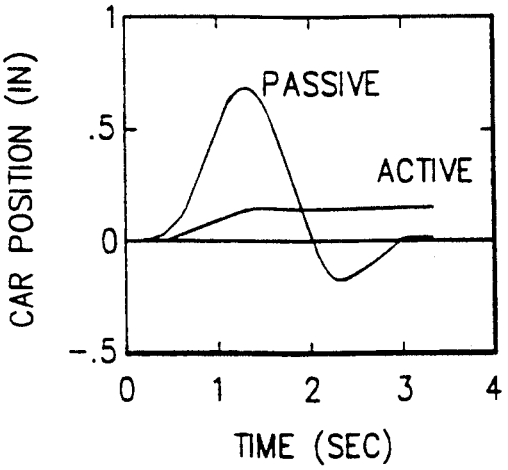
FIG.11B
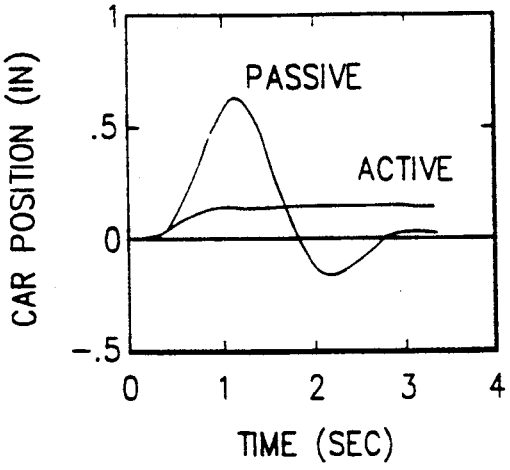
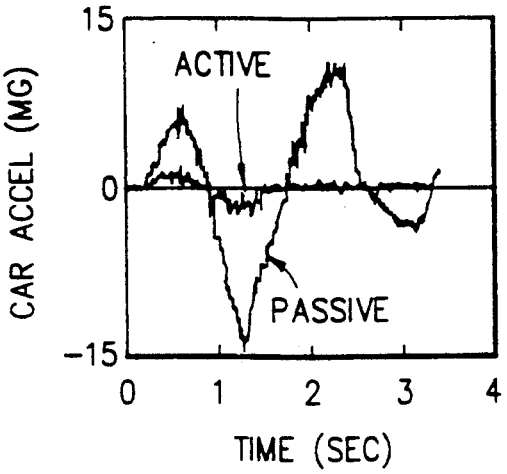
FIG.11C
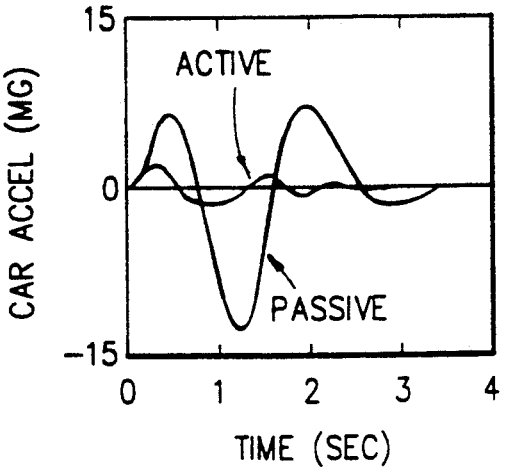
FIG.11D

ELEVATOR ACTIVE SUSPENSION SYSTEM

RELATED APPLICATIONS

This application discloses subject matter which may be disclosed and claimed in commonly owned, copending applications U.S. Ser. No. 07/555,135 entitled "Active Control of Elevator Pendulum Car", U.S. Ser. No. 07/555,133 entitled "Elevator Rotational Control", U.S. Ser. No. 07/555,140 entitled "Y-Shape Section for Elevator Guide Rail", U.S. Ser. No. 07/316,629 entitled "Active Control of Elevator Platform", and U.S. Ser. No. 07/555,131 entitled "Plural Bladed Rail".

TECHNICAL FIELD

This invention relates to elevators and, more particularly, improved ride quality.

BACKGROUND ART

Conventional elevator system suspensions can be characterized by the mechanical properties of the transmissive elements which connect three major elevator components: the car platform, the supporting frame, and the guide rails. The conventional elevator car platform is typically attached to the supporting frame with hard rubber pads. The frame, in turn, runs along the guide rails, which are supported either by stiffly sprung wheels or sliding gibs at four attachment points.

The motion of the car platform in these conventional elevator systems is affected by forces which act directly on the car, e.g., reactive forces due to passenger motion or wind forces, and by guide rail irregularities, e.g., butt joint misalignments, or waviness due to settling of the building. These conventional elevator suspension systems can be classified as "passive" in the sense that no energy is provided to the suspension system to counteract the direct or rail induced forces. For such passive systems, there is an inherent compromise in ride quality. Stiff transmissive elements mitigate the effects of direct car forces, while compliant (low stiffness) transmissive elements mitigate the effects of guide rail irregularities.

In U.S. Pat. No. 4,899,852 issued to Salmon et al, a passive suspension configuration is disclosed with a mechanically compliant attachment between the car platform and frame. The mechanically compliant attachment is realized by suspending the car platform from the frame with long steel rods. This elevator configuration, hereafter referred to as the "pendulum car" is a passive design in which the mitigation of the effects of rail irregularities is maximized at the expense of an increased sensitivity to direct car forces.

In a non-pendulum cab disclosure, U.S. Pat. No. 4,754,849, Hiroshi Ando shows electromagnets disposed outside the car symmetrically about guide rails in a control system using opposing forces from the electromagnets to keep the car steady using the rails as the necessary ferromagnetic mass but, rather than using the rails as a straight reference line, instead using a cable stretched between the top and bottom of the hoistway. The position of the car with respect to the cable is controlled using detectors in a closed loop control system. There is serious question as to whether such a cable can be successfully used as a reliable guide of straightness.

In another non-pendulum cab disclosure, U.S. Pat. No. 4,750,590, Matti Otala discloses what appears to be an essentially open loop control system with solenoid actuated guide shoes that uses the concept of memorizing the out-of-straightness of the guide rails for storage in a computer memory and then sensing the position of the car in the hoistway for the purpose of recalling the corresponding information from memory and correcting the guide rail shoe positions accordingly. An acceleration sensor is mentioned in claim 6 but does not appear to be otherwise disclosed as to its purpose in the specification or drawing. Perhaps it is used to determine the acceleration of the car in the hoistway. Such an acceleration signal would presumably be needed to determine which data point to retrieve from memory as suggested in claim 2. Otala's approach suffers from the problem of changes in the out-of-straightness before a correction run can be effected and the accuracy with which the stored information can be made to conform to the car's actual position.

A mounting arrangement for a pendulum-type or hung cab is shown in U.S. Pat. No. 4,113,064 by Shigeta et al wherein the cab is suspended within and from the top of an outer car framework by a plurality of rods connected to the bottom of the cab. A plurality of stabilizing stoppers are shown interposed between the underside of the hung cab and the floor of the car frame. Each stopper comprises a cylinder extending downward from the underside of the hung cab surrounding a rubber torus placed on an upright rod extending from the floor of the car frame. Clearance between the cylinder and the hung cab is sufficient to permit movement but insufficient to allow the hung cab to strike the car frame. Another embodiment comprising "bolster" means having ball bearings permits movement in any direction of the horizontal plane.

Another approach is disclosed by Luinstra et al in U.S. Pat. No. 4,660,682 wherein a pair of parallel rails are arranged horizontally in a parallelogram between the suspended cab and car frame with followers arranged to roll or slide on the rails in such a way that the hung cab can move in any horizontal direction relative to the car frame.

Both of the last two pendulum or supported cab approaches employ passive restraints on movement which by nature are reactive rather than active.

Active suspension systems are known in the automobile art. In particular, what we call "tunable shock absorbers" are used as tunable impedances. They comprise a relative displacement device made up, from a "systems" point of view, of a mechanical impedance (defined here as the frequency dependent ratio of deflection over applied force) of a stiffness in parallel with a damper. The stiffness and dampening elements are adjusted during different conditions. For example, during a cornering mode, as sensed by accelerometers, increased stiffness is desired on selected shock absorbers. Similarly, during braking, both front shocks are made stiffer. This is done in software by sensing the displacement of the car with respect to the frame and commanding a desired displacement. In simply adjusting stiffness and damping there is a trade-off; as the mechanical impedance of the shock absorbers is increased, the car becomes more sensitive to a bumpy road. Or, as the mechanical impedance of the shock absorbers is decreased, the car becomes more susceptible to direct forces, other than bumpiness.

In our study of improved ride quality, we compared the frequencies of disturbances caused by rail bumpiness in elevators to the frequency manifestations of direct forces and found, at least for elevators, a critical area of between two to ten Hertz where we could not satisfy both our desire to reduce mechanical impedance to cure rail bumpiness and our desire to increase mechanical impedance to mitigate direct forces. At least for elevators, this problem very significantly limits the effectiveness of the tunable impedance active suspension approach used in automobiles.

DISCLOSURE OF INVENTION

The object of the present invention is to improve the ride quality of elevators.

According to the present invention, ride quality of elevators may be improved by a multi-axis, active suspension system which utilizes a sensor, a control, and an actuator in each axis to minimize perceived car platform motion.

In further accord with the present invention, multi-axis control components are brought to bear to act on the elevator car to reduce car motion for all lateral degrees of freedom due to external disturbances.

In still further accord with the present invention, accelerometers mounted on the elevator car provide a signal indicating the presence of disturbances.

In still further accord with the present invention, a control is responsive to a sensed signal to process the sensed signal to drive an actuator with a frequency response tailored to achieve a stable, high-performance, drift-free system.

In still further accord with the present invention, in regions where car motion is to be minimized, the loop gain is made greater than 1. At high frequencies, the loop gain is rolled off to meet stability robustness requirements. At low frequencies, the loop gain is "washed-out" to reduce the effects of sensor noise and drift.

The elevator active suspension system disclosed herein represents a unique combination of a sensor, a control, and an actuator applied in an axis to minimize the effects of rail-induced disturbances and direct car forces.

An elevator, in going up and down a hoistway, is subjected to disturbances due to rail irregularities which have a frequency content not unlike the disturbances caused by other forces, which we call direct forces. Unfortunately, unlike the case for automobiles, the frequency content of rail-induced disturbances is in the same range of frequencies encountered at the same time in the disturbances caused by direct forces. Direct forces can be most effectively countered by high mechanical impedance, while rail irregularities can be effectively countered by low mechanical impedance. In automobiles, there are well defined modes to detect, such as cornering, acceleration and deceleration, which may be effectively counteracted using the tunable impedance as previously described. In our approach, according to the teachings of our invention, we generate forces directly in response to sensed acceleration, and only the restoring force of the pendulum controls the relative displacement between the car and frame or hoistway.

These and other objects, features and advantages of the present invention will become more apparent in light of the following detailed description of a best mode embodiment thereof, as illustrated in the accompanying drawings.

BRIEF DESCRIPTION OF THE DRAWINGS

FIG. 8 is an illustration of a digital control which may be used in implementing the control of FIG. 2A;

FIG. 9 is an illustration of a series of steps which may be carried out by the processor of FIG. 8;

FIGS. 11A–D shows a comparison of the predicted time response (via simulation) and the achieved response for direct car force mitigation;

BEST MODE FOR CARRYING OUT THE INVENTION

Figure 1A:
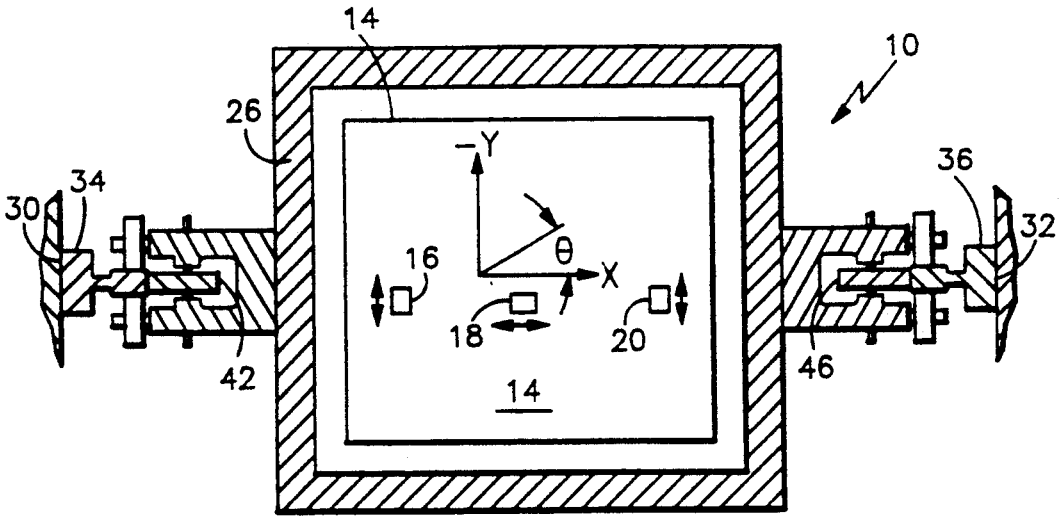
FIG. 1A is a top view of a pendulum car shown in FIG. 1B from the side.
Figure 1B:
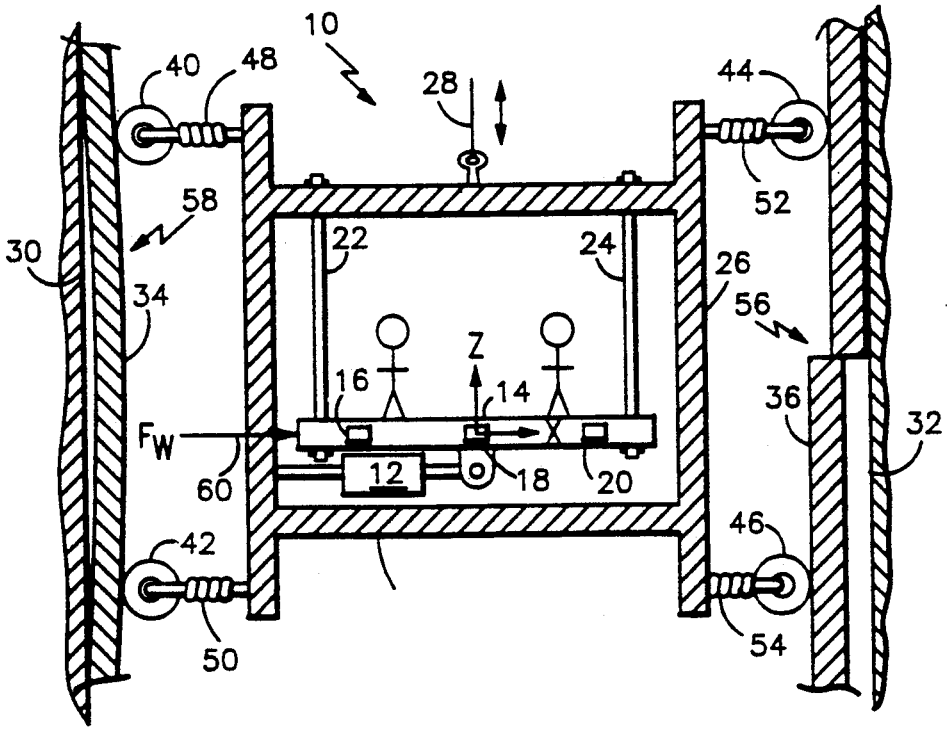
FIG. 1B is a side view of the pendulum car of FIG. 1A with an active suspension shown, according to the present invention.

FIG. 1A is a top view and FIG. 1B is a side view of a pendulum car 10. It includes an active suspension system according to the present invention comprising an actuator 12 shown in FIG. 1B, driven by a control (not shown) to process sensed data relative to the motion of car platform 14. Sensors 16,18,20, which may be accelerometers, measure the platform motion. The platform 14 is suspended by rods 22,24 from a frame 26 which is suspended by a cable 28 for moving the car up and down in an elevator hoistway having walls 30,32 with rails 34,36 mounted thereon. A plurality of wheels 40,42,44,46 are mounted by means of springs 48,50,52,54 to the platform 26. A pendulum car of this type, without an active suspension is shown in detail in U.S. Pat. No. 4,899,852.

In moving up and down the hoistway, the wheels are subjected to bumpiness in the rails, e.g., caused by a rail butt joint misalignment 56 or waviness 58. Such butt joint irregularities induce relatively high frequency car vibrations, while waviness usually produces lower frequency vibrations. In addition to vibrations imparted to the platform 26 by rail irregularities, the platform is subjected to what we call direct forces 60, which may comprise a large number of different influences, including wind forces, motion of people within the car standing on the platform, and numerous other forces.

A coordinate system is shown in both FIGS. 1A and 1B and shows an X-Z plane in the floor of the platform with the Y-axis in the vertical direction. The present invention mitigates both direct forces and rail irregularity forces imparted to the platform 14 through the frame. It does this by counteracting lateral forces in both the X and Z directions. Rotations about the Y-axis are mitigated also by virtue of lateral control along the X and Z axes as disclosed below.

FIG. 2 is a block diagram of a specific implementation of an active suspension system, according to the present invention. For one axis (e.g., side-to-side along the X-axis passing through the car's vertical centerline), and for the other axes (e.g., front-to-back along two axes parallel to the Z-axis and lying equidistantly from and on opposite sides of the vertical centerline), there is a separate feedback loop, as shown in single axis form in FIG. 2. An acceleration reference signal may be input on a line 100 and may be set to zero. The difference between the reference signal on the line 100 and a measured car acceleration signal on a line 102 forms an error signal on a line 104, which is in turn fed into a feedback compensator 106 labeled C(s).

C(s) may be characterized as follows:

$$\frac{F_{cmd}}{Accel} = \underbrace{\frac{S}{S+\omega_1}}_{\substack{DC\\ \text{Washout}}} \cdot \underbrace{\frac{S^2 + 2\zeta_P\omega_P S + \omega_P^2}{GOLS^2}}_{\text{Pendulum Compensation}} \cdot \underbrace{\frac{S^2}{\text{GAIN}(S+\frac{1}{4}\omega_1)(S+\omega_0)^2(S+4\omega_2)}}_{\text{Control}}$$

$\omega_1$ = Low control band frequency [rad/s]
$\omega_2$ = High control band frequency [rad/s]

$$\omega_0 = \sqrt{\omega_1 \cdot \omega_2}$$

Gain = Control gain selected so that loop gain @ $\omega_1\omega_2 = 1$ $GOL$ = Open loop system gain $\frac{[mg]}{N}$ $\omega_P$ = Pendulum resonant frequency [rad/s]
$\zeta_P$ = Pendulum damping ratio.

The first term covers DC washout, the second is for pendulum compensation, and the third term is for control.

The feedback compensator in each axis processes the car acceleration error signal for that axis to generate actuator commands. In this case, a force command signal is provided on a line 110. These compensators can be viewed as dynamic filters whose properties (gain and phase vs. frequency) are designed to meet elevator system requirements. The design of C(s) can be recast into design requirements on the overall loop gain, labeled L(s), which is the product of C(s) and the plant dynamics as illustrated in a block 108, labeled G(s). The force command signal on the line 110 is provided to plant dynamics 108. As shown in FIG. 2B, in regions where car acceleration is to be minimized, the loop gain is made to be greater than 1, i.e., in a region about a frequency $\omega_0$. At high frequencies, above $\omega_2$, the loop gain is "rolled off" to meet stability robustness requirements. At low frequencies, below $\omega_1$, the loop gain is "washed-out" to reduce the effects of sensor noise and drift.

Figure 3A:
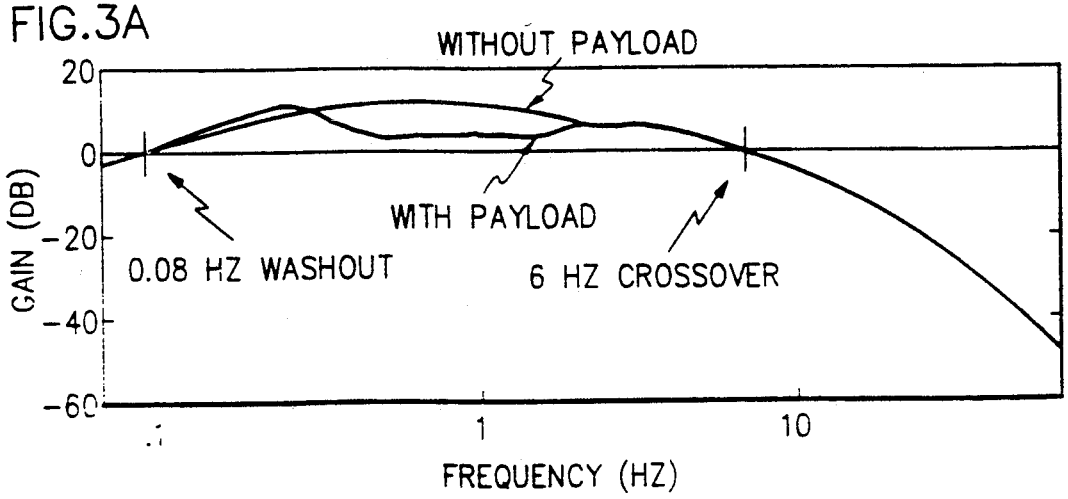
FIGS. 3A & 3B are plots of the open-loop gain and phase angle of the product (L(s)) of C(s) and G(s) in FIG. 2A.
Figure 3B:
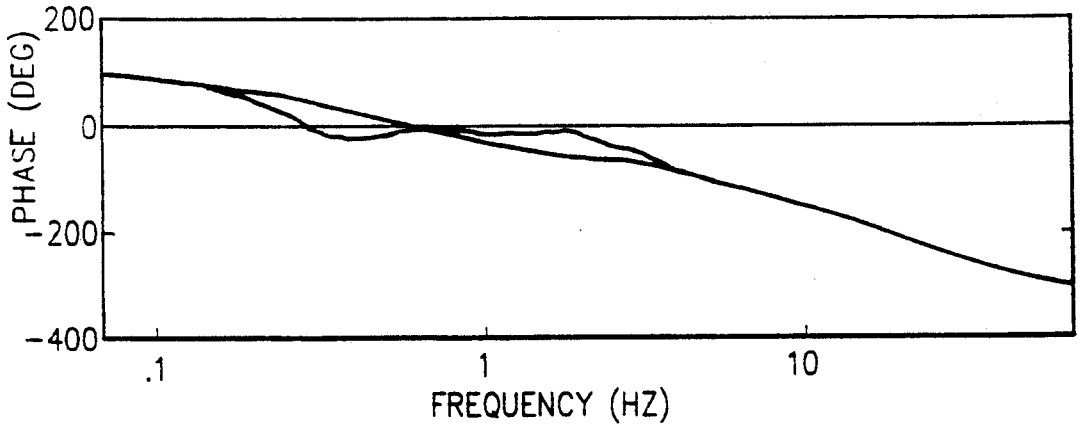
Figure 4A:
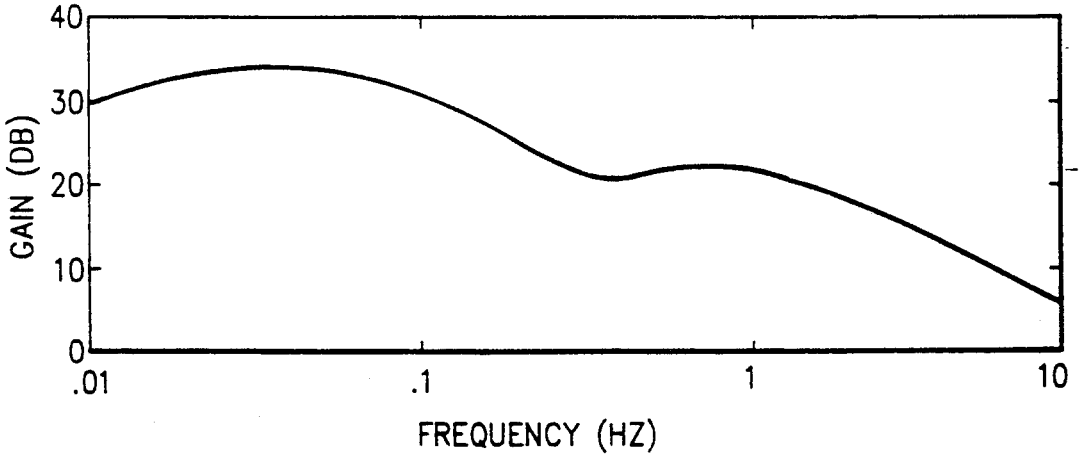
FIGS. 4A & 4B are plots of the feedback compensator gain and phase angle for a particular design according to the present invention.
Figure 4B:
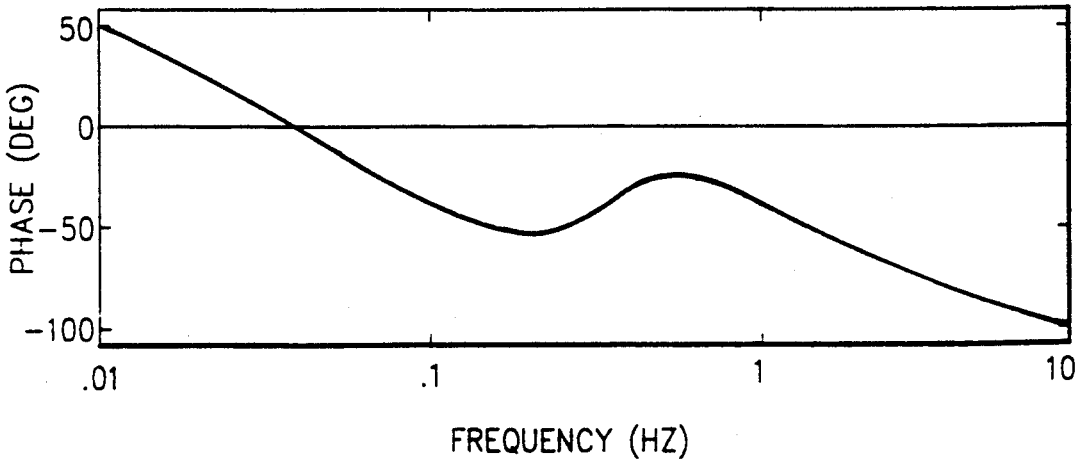
Figure 5A:
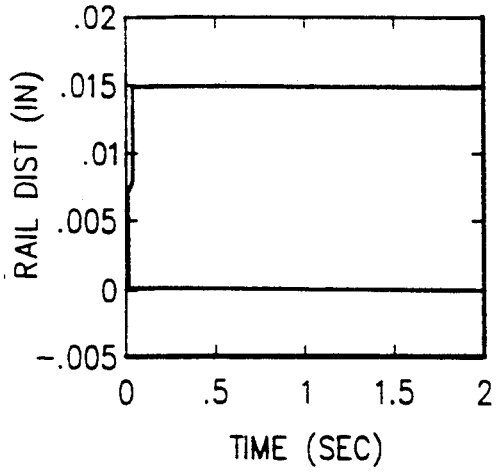
FIGS. 5A–D, 6A–D & 7A–D summarize the results of a simulation study of an active suspension system using the compensator of FIGS. 2–4, an active suspension system, according to the present invention.
Figure 5B:
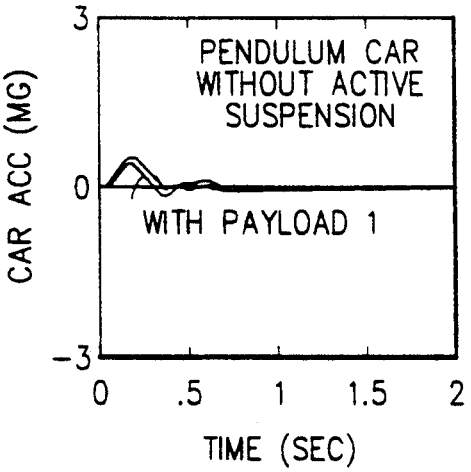
Figure 5C:
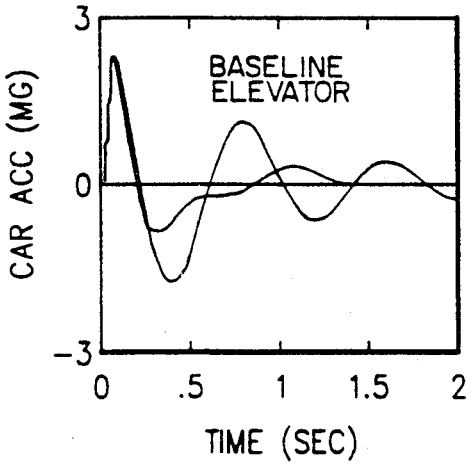
Figure 5D:
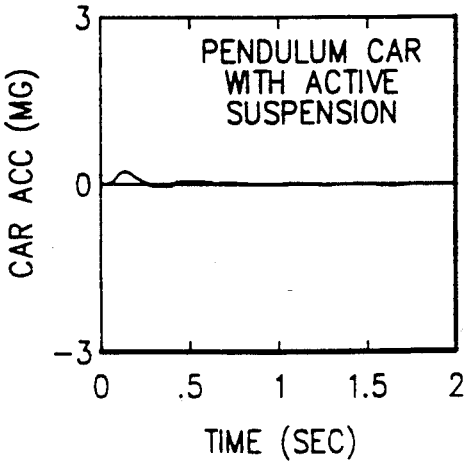
Figure 6A:
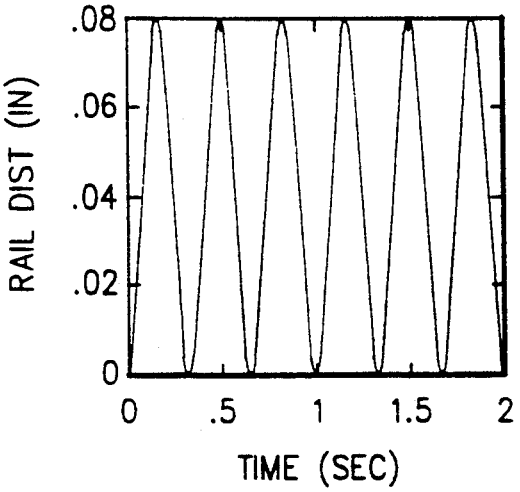
Figure 6B:
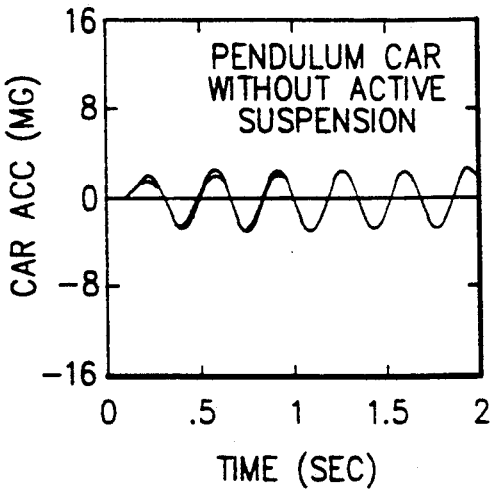
Figure 6C:
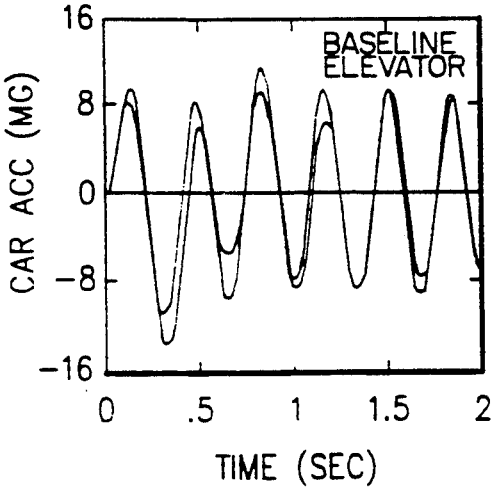
Figure 6D:
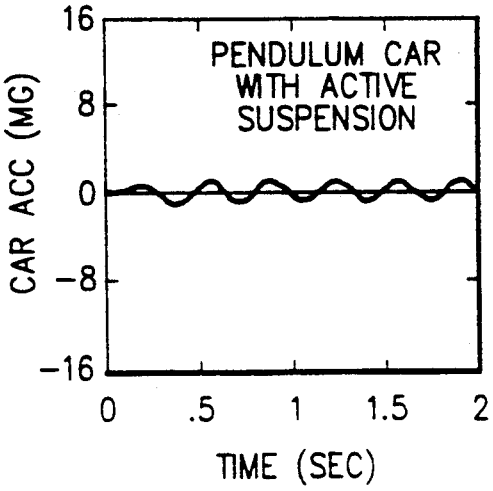
Figure 7A:
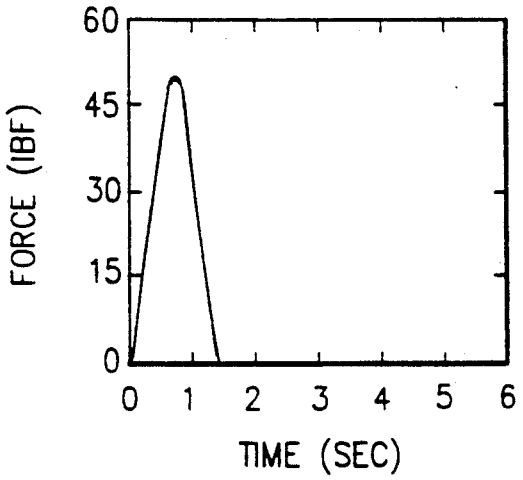
Figure 7B:
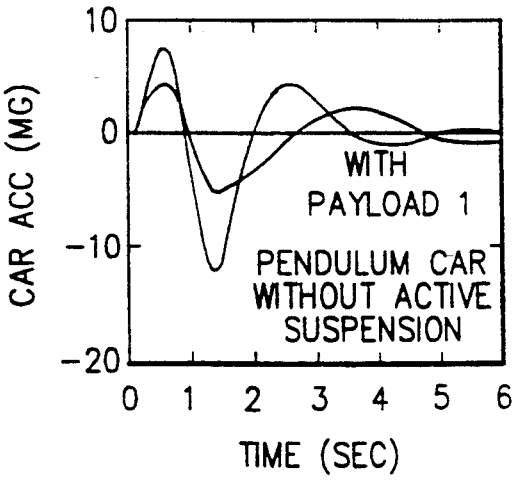
Figure 7C:
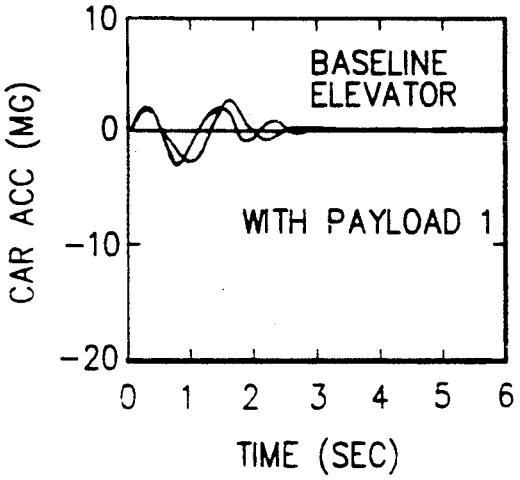
Figure 7D:
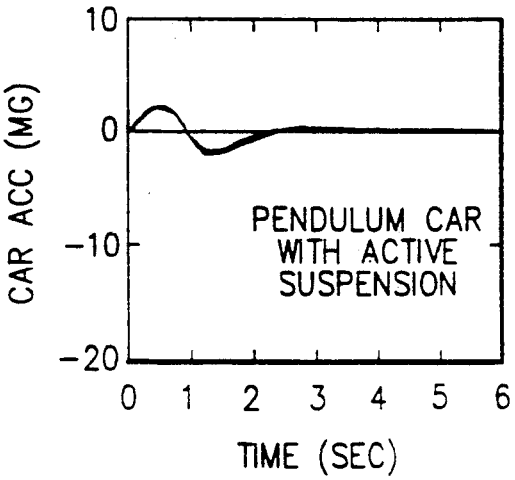

Based on the model of the pendulum car of U.S. Pat. No. 4,899,852, we performed an analysis of the performance of an active suspension concept. FIGS. 3A & 3B are actually a plot of the designed open loop transfer function for an active system, L(s), that resulted from that analysis. A plot of the feedback compensator gain and phase angle are shown, respectively, in FIGS. 4A and 4B for this particular design.

FIGS. 5 through 7 summarize the results of a simulation study of the performance of the resulting active suspension system. The upper lefthand plots in each of these figures (labeled (a)) is the particular disturbing input (direct car force or rail profile). The remaining plots on each of these figures show the car acceleration response for three configurations: (1) pendulum car (upper-right, labeled (b)), (2) conventional car (lower-left, labeled (c)), and (3) active suspension using the control design of FIGS. 2–4 (lower-right, labeled (d)). It can be seen that this system reduces the levels of cab platform acceleration relative to conventional systems and even those of the pendulum car without active control.

FIG. 5 is the predicted response to butt joint misalignment.

FIG. 6 is the predicted response to rail waviness.

FIG. 7 is the predicted response to car force disturbance.

Tests have been conducted utilizing a half scale model of the elevation system shown in FIGS. 1A and 1B. The effectiveness of the concept was performed using a rotating imbalance mounted on the frame to simulate rail-induced disturbances and by simulating a direct disturbance force by means of an actuator between the frame and cab.

Figure 2A:
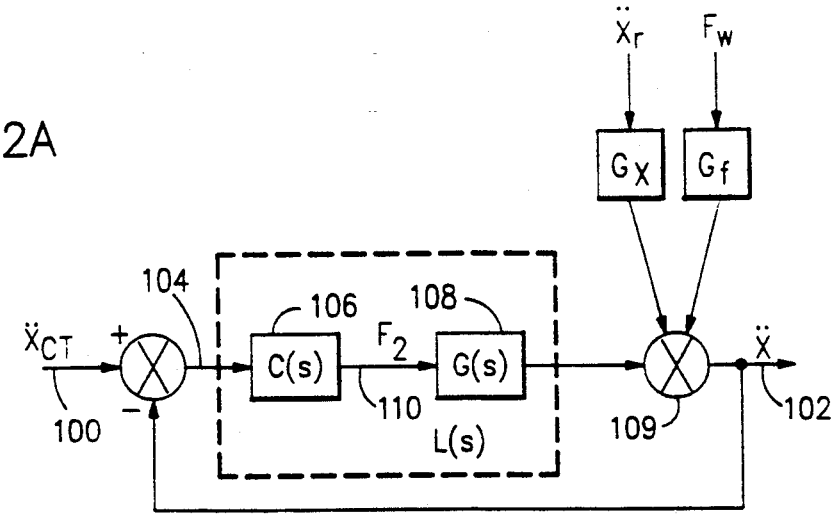
FIG. 2A is a systems level block diagram of a specific implementation of an active suspension system, according to the present invention.
Figure 2B:
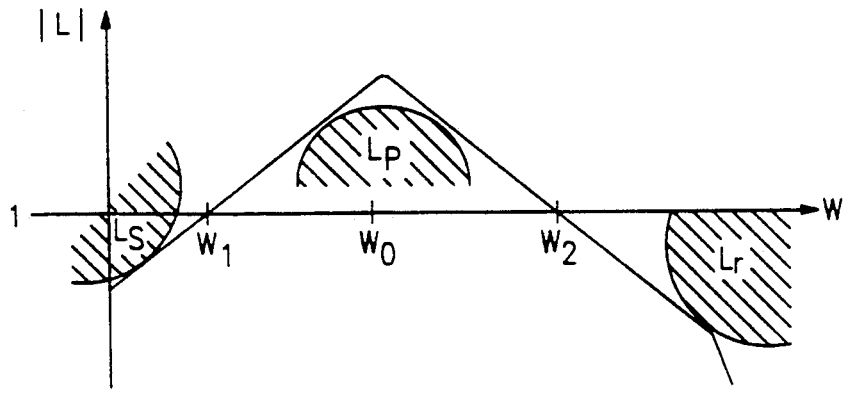
FIG. 2B is a qualitative presentation of our design requirements on the overall loop gain, according to the present invention.

The feedback compensator 106 of FIG. 2A was implemented using a digital computer 100 as shown in FIG. 8. Sensor 102 data is provided on a line 103 into a 12-bit A/D converter (not shown) to be processed after passing through an Input/Output Port 104. A digital form of the feedback compensator 106 was utilized to produce a command signal on a line 106 to an actuator capable of exerting forces on a car 110.

The signal processor 100 comprises a central processing unit 104*a*, a read-only memory 104*b*, a random access memory 104*c*, all communicating by means of data, address, and control bus 104*d*.

FIG. 9 is an illustration of a series of steps which may be carried out by the signal processor 100 of FIG. 8. For example, after entering in a step 112, acceleration is sensed in a step 114 by means of an accelerometer, such as sensor 102. The processor then computes the magnitude of a counteractive force by implementing the dynamic compensation 106. A step 118 is next executed in which the signal processor 100 provides the counteraction signal on line 106 which may be a counterforce signal, such as the signal on line 106 and as computed in step 116. An exit is then made in a step 120.

Figure 10:
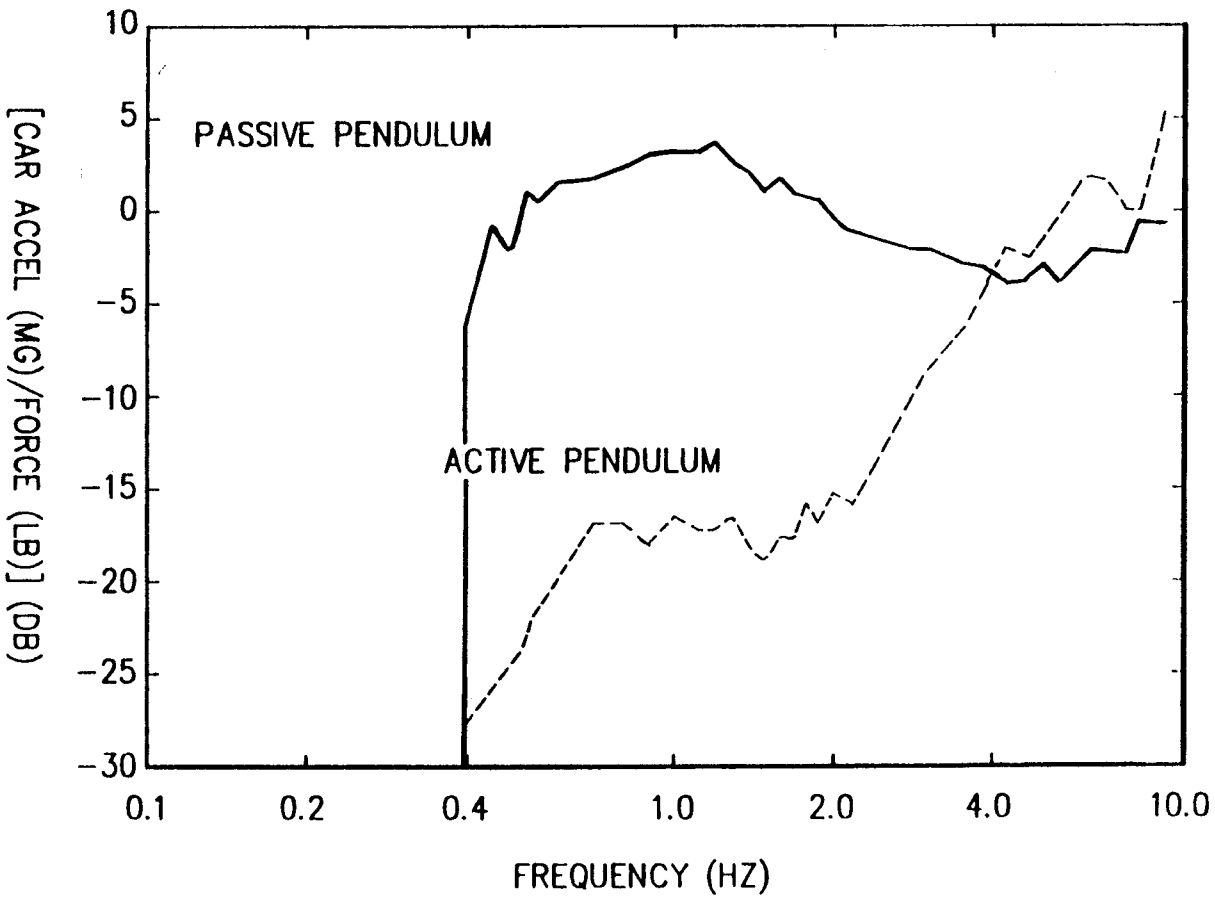
FIG. 10 shows the results of a test to evaluate the effectiveness of the active system in mitigating direct car forces which shows a ratio of the measured car acceleration to the magnitude of a sinusoidal input force over a sweep of frequencies.

FIG. 10 shows the results of a test to evaluate the effectiveness of the active system in mitigating direct car forces. The plot shows the ratio of the measured car acceleration to the magnitude of the sinusoidal input force over a sweep of frequencies. The top curve is the response of the pendulum car system without active suspension control. The bottom curve response of the active suspension system verifies the expected 80%–90% reduction. FIG. 11 shows a comparison of the predicted time response (via simulation in FIGS. 11(*b*) & (*d*)) and the achieved (experimental) time response (FIGS. 11(*a*) & (*c*)) for direct car force mitigation.

Figure 12A:
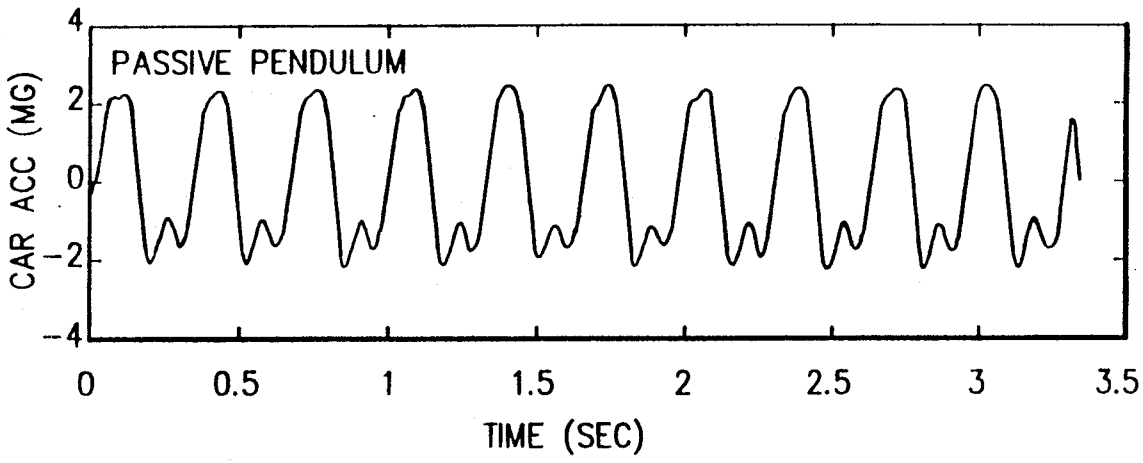
FIGS. 12A & B illustrates the response of the system to a rail irregularity as simulated on a test bed with a rotating imbalance.
Figure 12B:
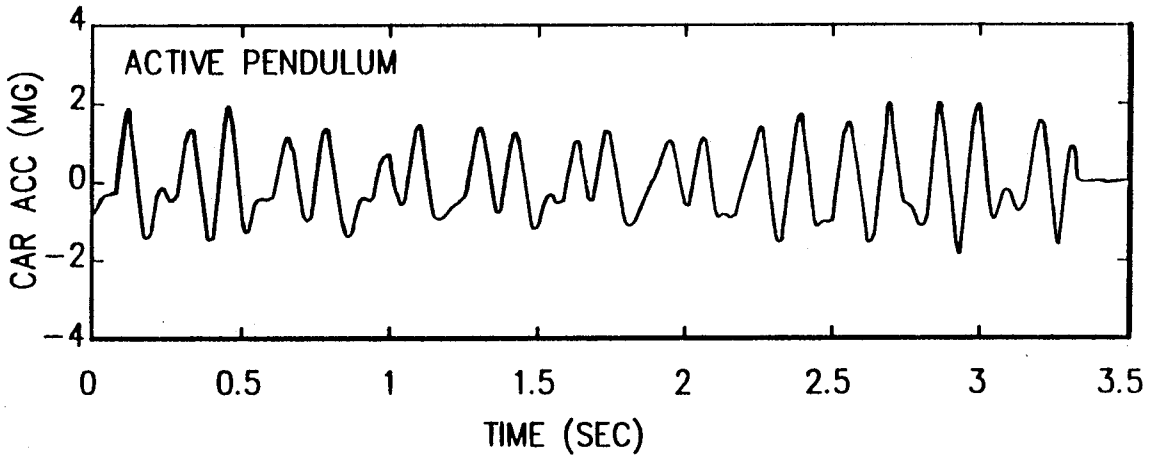

This reduction in the system sensitivity to direct car forces was achieved without compromising the performance of the system in the presence of rail-induced disturbances. FIG. 12 illustrates the response of the system to a rail irregularity as simulated on a test bed with a rotating imbalance. FIG. 12(*a*) shows the unaugmented pendulum car response to a 3 Hz input frequency. FIG. 12(*b*) is the response of the active suspension system. It can be seen that the magnitude of the car acceleration has been decreased. Thus, the active suspension system improves the ride quality using car acceleration as the metric of performance in the presence of both rail-induced disturbances and direct car forces.

Figure 13:
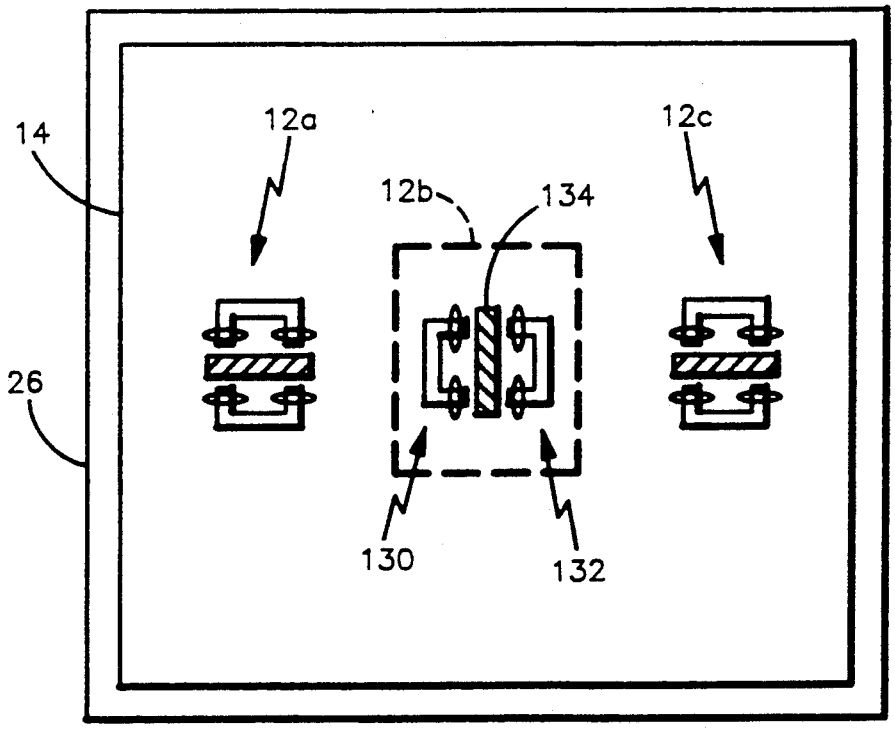
FIG. 13 is an illustration of a group of electromagnetic actuators situated between the underside of the suspended cab and the floor of the car frame.

FIG. 13 is a top view of the pendulum car of FIG. 1B looking down from the bottom surface of the platform 14 of an actuator arrangement in the space between the car frame's floor and the underside of the suspended cab. In this case, we have shown three actuators 12(*a*), 12(*b*), 12(*c*) in lieu of the single actuator 12 shown in FIG. 1B. The actuators shown in FIG. 13 are of the electromagnetic type to be described in detail below. The orientation of the platform 14 is the same as is shown in FIG. 1A and the same coordinate system applies. Thus, the actuator 12(*b*) produces forces along the X-axis while the actuators 12(*a*), 12(*c*) produce forces along axes parallel to the Z-axis. As explained previously, in connection with FIGS. 2A and 2B, each of the actuators 12(*a*), 12(*b*), 12(*c*) has a separate control loop which is independent of the others at least in the sense of not depending on sensors in any other axis. It will, of course, be understood that the various axes of control are mechanically coupled.

In the copending applications cited at the beginning of the specification, several active suspension inventions are disclosed which describe embodiments of those inventions which include separate, single-axis controls such as disclosed herein in connection with FIG. 13, and which applications also describe combined, multi-axis control channels. To the extent that a combined, multi-axis control may be used in practicing the presently claimed invention, we hereby incorporate those documents by reference as alternate embodiments. It should be understood that the separate, single-axis controls disclosed herein are advantageous for simplicity of design and for the advantage of being able to electronically decouple the various control axes. It will be noted, however, that the approach disclosed herein is somewhat more expensive than the combined, multi-axis approach because of the added number of electromagnets required. On the other hand, there are only three channels of electronics required in the separate channels while the combined, multi-axis approach requires a minimum of four channels of electronics.

Figure 14:
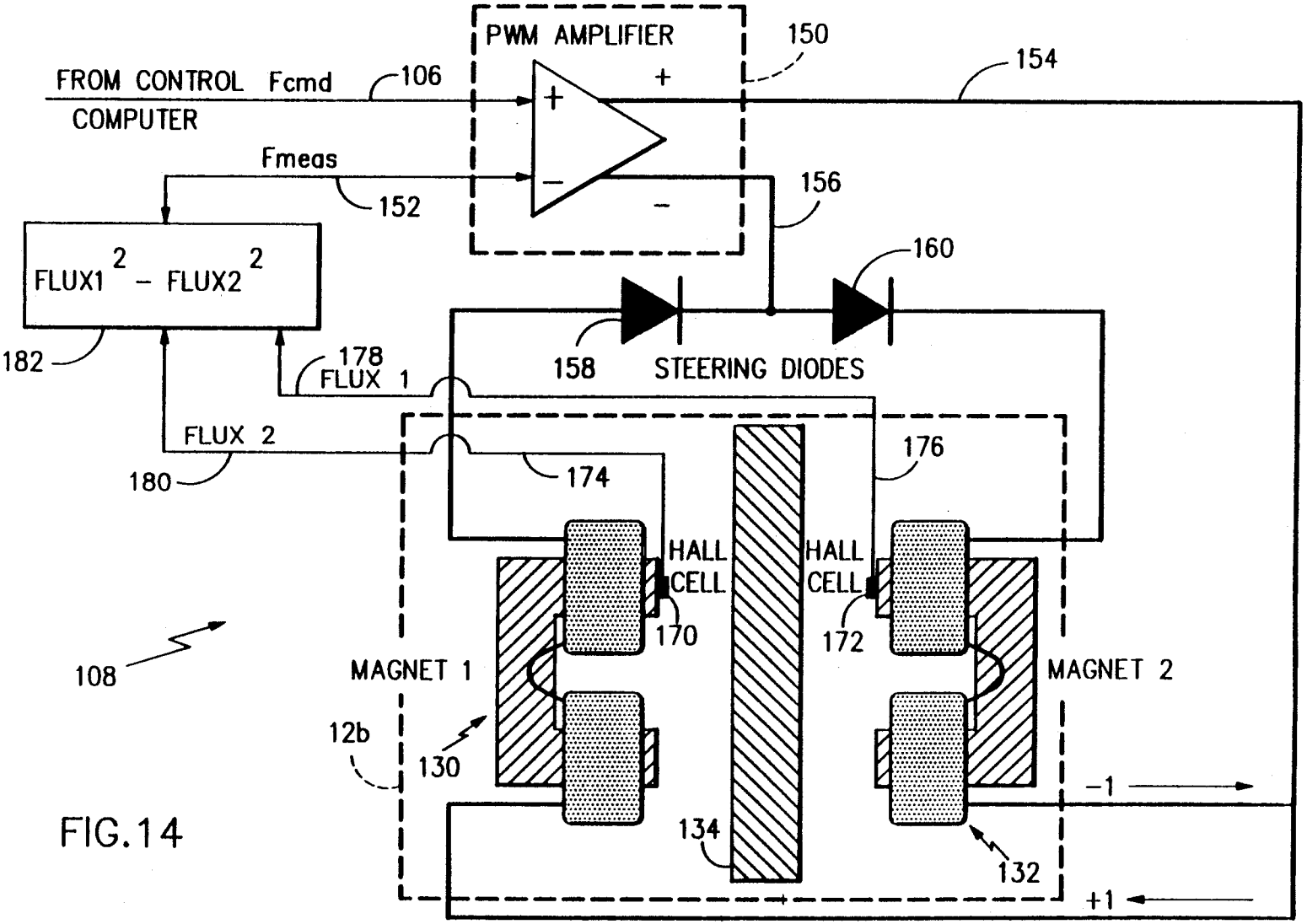
FIG. 14 is a detailed schematic of a circuit for controlling one of the electromagnets of FIG. 13 in response to a force command signal from a signal processor, such as is illustrated in FIG. 8.

In any event, the actuator command signal on line 106 as shown in FIG. 8 may be a force command signal, as previously explained, and as shown in more detail in FIG. 14, as being applied to a particular actuator which may include, for example, the core-coils and ferromagnetic plates of FIG. 13.

In FIG. 14, the force command signal on line 106 from the signal processor 100 of FIG. 8 is provided to a PWM amplifier which may be made by Copley Controls Corp. of 375 Elliot Street, Newton, Massachusetts, U.S.A., and called a "Class B PWM Servo Amplifier Model 218A" as described in published specification sheet entitled "Model 215A, 218 Servo Amplifier". The PWM Amplifier 150 is responsive also to a force feedback signal on a line 152. The PWM amplifier serves as an electronic double pole-double throw switch to apply a selected voltage to lines 154,156 with a polarity reversal at a selected duty cycle. A pair of steering diodes 158, 160 steer the output current on either line 154 or 156 into the proper coil of the corresponding magnet 130, 132. It will be understood that either the ferromagnetic mass 134 or the electromagnets will be erected on the base of the frame 26 while the other element is erected on the bottom surface of the platform 14. In a preferred embodiment, the electromagnets 130, 132 are erected on the bottom of the plane 26 while the ferromagnetic mass 134 is fixedly attached to the bottom of the platform 14. This is the case for the other actuators 12(*a*), 12(*c*) as well.

In order to construct an effective feedback loop, Hall cells 170, 172 may be placed in the magnetic circuit path so as to sense magnetic flux in the gap between the ferromagnetic plate 134 and the respective cores of core-coils 130, 132. The Hall cells 170, 172 provide sensed flux signals on lines 174, 176, respectively, to a device 182, which may be a multiplying IC such as an AD 534, which squares the magnitudes of the flux signals on lines 174, 176 and provides a difference signal indicative of the difference therebetween as the force feedback on line 152.

Thus, although the invention has been shown and described with respect to a preferred embodiment thereof, it should be understood by those skilled in the art that the foregoing and various other changes, omissions, and additions may be made therein without departing from the spirit and scope of the invention.

We claim:

1. Apparatus for stabilizing a cab suspended in an elevator car frame in a hoistway, comprising:

sensor means, responsive to magnitude and phase of a selected parameter associated with said suspended cab, for providing a sensed signal indicative thereof;

control means, responsive to said sensed signal, for providing a control signal having a magnitude and phase selected according to said magnitude and phase of said selected parameter; and actuator means, responsive to said control signal, for actuating said suspended cab, wherein said sensor means comprises at least three sensors for sensing translational movements of said cab and for providing three sensed signals indicative thereof to said control means for computing corresponding forces required to counteract said sensed movements.

2. The apparatus of claim 1, wherein two of said three sensors are situated to sense horizontal translational movement along parallel axes perpendicular to a third horizontal axis.

3. Apparatus for stabilizing a cab suspended in an elevator car frame in a hoistway, comprising:

sensor means, responsive to a magnitude and phase of a selected parameter associated with said suspended cab, for providing a sensed signal indicative thereof;

control means, responsive to said sensed signal, for providing a control signal having a magnitude and phase selected according to said magnitude and phase of said selected parameter; and actuator means, responsive to said control signal, for actuating said suspended cab, wherein said control means comprises means responsive to said sensed signal for providing a command signal and further comprises means responsive to a sensed signal indicative of a response of said cab to said actuator means for comparison to said command signal.

4. Apparatus for stabilizing a cab suspended in an elevator car frame in a hoistway, comprising:

sensor means, responsive to a magnitude and phase of a selected parameter associated with said suspended cab, for providing a sensed signal indicative thereof;

control means, responsive to said sensed signal, for providing a control signal having a magnitude and phase selected according to said magnitude and phase of said selected parameter; and actuator means, responsive to said control signal, for actuating said suspended cab, wherein said control means provides a force command signal in response to said sensed signal and further comprises comparator means for comparing the magnitude of said force command signal to the magnitude of a force feedback signal and wherein said control signal is proportional to an error signal having a magnitude indicative of a difference between said magnitudes of said force command signal and said force feedback signal.

5. The apparatus of claim 4, wherein said actuator means is an electromagnet and further comprises a sensor for sensing magnetic flux density in a gap associated with said electromagnet for providing a flux signal and wherein the magnitude of said flux signal is squared and multiplied by a factor having dimensions of newton per tesla squared in order to provide said flux signal as a force feedback signal for comparison with said force command signal.

6. The apparatus of claim 5, wherein said control means further comprises:

means, responsive to said error signal for providing a firing signal;

switching means, responsive to said firing signal, for providing said control signal as said current to said electromagnet for exerting a force against said cab.

7. The apparatus of claim 6, wherein said switching means is a pulse-width modulated amplifier.

8. A method for stabilizing a cab suspended in an elevator car frame in a hoistway, comprising the steps of:

sensing a selected parameter associated with the suspended cab and providing a sensed signal indicative thereof;

providing a control signal comprising a summation of signal components of said sensed signal, each component signal increased or decreased and shifted in phase according to a function of gain and phase shift versus component signal frequency;

actuating said suspended cab in response to said control signal, and wherein said step of sensing comprises the step of sensing translational movement of the cab by providing said sensed signal as three sensed signals indicative thereof for providing said control signal as one or more control signals required to counteract movements indicated by said sensed signals, and wherein two of said three sensed signals are indicative of translational movement of the cab along lines situated on opposite sides of the cab centerline and parallel to a signal selected axis and wherein a single sensed signal is indicative of translational movement along an axis perpendicular to said single selected axis.

9. The method of claim 8, wherein said movements indicated by said sensed signals are translational and rotational movement of said cab.

10. The method of claim 8, wherein said three sensed signals are indicative of accelerations present in said movements.

11. A method for reducing horizontal acceleration of an elevator cab, comprising the steps of sensing said acceleration, providing a sensed acceleration signal having a magnitude indicative thereof, providing a counteraction signal having a magnitude and phase selected according to said magnitude of said sensed acceleration signal and counteracting said sensed acceleration in response to said counteraction signal, wherein said magnitude of said counteraction signal is selected according to a compensation function having negative gain (dB) or less than unity gain below a first selected frequency $\omega_1$ and also above a second selected frequency $\omega_2$ and positive gain (dB) or gain greater than unity in between.

12. The method of claim 11, wherein said first selected frequency is less than two Hertz.

13. The method of claim 11, wherein said second selected frequency is less than ten Hertz and greater than two Hertz.

14. Apparatus for reducing horizontal acceleration of an elevator cab comprising:

means for sensing said acceleration and for providing an acceleration signal having a magnitude indicative thereof; and means responsive to said acceleration signal for exerting against said cab a counterforce having a magnitude and phase selected according to said magnitude of said acceleration signal, wherein said magnitude of said counterforce is selected according to a compensation function having negative gain (dB) or less than unity gain below a first selected frequency $\omega_1$ and also above a second selected frequency $\omega_2$ and positive gain (dB) or gain greater than unity in between.

15. The apparatus of claim 14, wherein said first selected frequency is less than two Hertz.

16. The apparatus of claim 14, wherein said second selected frequency is less than ten Hertz and greater than two Hertz.

17. Apparatus for stabilizing a cab suspended in an elevator car frame in a hoistway, comprising:

sensor means, responsive to a magnitude and phase of a selected parameter associated with said suspended cab, for providing a sensed signal indicative thereof;

control means, responsive to said sensed signal, for providing a control signal having a magnitude and phase selected according to said magnitude and phase of said selected parameter; and actuator means, responsive to said control signal, for actuating said suspended cab, wherein said magnitude of said control signal is selected according to a compensation function having negative gain (dB) or less than unity gain below a first selected frequency $\omega_1$ and also above a second selected frequency $\omega_2$ and positive gain (dB) or gain greater than unity in between $\omega_1$ and $\omega_2$.

18. The apparatus of claim 17, wherein said first selected frequency is less than two Hertz.

19. The apparatus of claim 17, wherein said second selected frequency is less than ten Hertz and greater than two Hertz.

20. A method for stabilizing a cab suspended in an elevator car frame in a hoistway, comprising the steps of: sensing a selected parameter associated with the suspended cab and providing a sensed signal indicative thereof;

providing a control signal comprising a summation of signal components of said sensed signal, each component signal increased or decreased and shifted in phase according to a function of gain and phase shift versus component signal frequency the magnitude of said control signal is selected according to a compensation function having negative gain (dB) or less then unity gain below a first selected frequency $w_1$ and above a second selected frequency $w_2$ and a positive or greater then unity in between; and actuating said suspended cab in response to said control signal.

21. The method of claim 20, wherein said first selected frequency is less than two Hertz.

22. The method of claim 20, wherein said second selected frequency is less than ten Hertz and greater than two Hertz.

23. A method for reducing horizontal acceleration of an elevator car, comprising the steps of sensing said acceleration, providing a sensed acceleration signal having a magnitude indicative of said acceleration and having signal components of differing magnitudes in a frequency spectrum, said components together having a magnitude indicative of said magnitude of said sensed acceleration signal and, in response to said signal components, providing a counteraction signal comprising a summation of said signal components multiplied by various corresponding gain factors selected according to a function of gain and component frequency which provides maximum gain and minimum phase shift in a central region of a selected range of frequencies, and further comprising the step of counteracting said sensed acceleration in response to said counteraction signal.

24. The method of claim 23, wherein said magnitude of said counteraction signal is selected according to a compensation function having negative gain (dB) or less than unity gain below a first selected frequency $\omega_1$ and also above a second selected frequency $\omega_2$ and positive gain (dB) or gain greater than unity in between.

25. The method of claim 24, wherein said first selected frequency is less than two Hertz.

26. The method of claim 24, wherein said second selected frequency is less than ten Hertz.

27. The method of claim 23, wherein said function provides increasing phase shift at frequencies above said central region.

28. Apparatus for reducing horizontal acceleration of an elevator car, comprising:

means for sensing said acceleration and for providing an acceleration signal having a magnitude indicative thereof and having signal components of differing magnitudes at differing frequencies; and means responsive to said acceleration signal for exerting against said car a counterforce having a magnitude comprising a summation of said signal components multiplied by various corresponding gains selected according to a function of gain and phase shift versus frequency which provides maximum gain and minimum phase shift in a central region of a selected range of frequencies.

29. The apparatus of claim 28, wherein said means for exerting counterforces comprises a plurality of electromagnets.

30. Apparatus for horizontally stabilizing an elevator car, comprising:

sensor means, responsive to acceleration of said car, for providing a sensed signal indicative thereof comprising component signals having differing magnitudes at differing frequencies;

compensation means, responsive to said sensed signal, for providing a control signal having a magnitude comprising a summation of said component signals each increased or decreased according to a function of gain and phase shift versus component frequency which function provides maximum gain and minimum phase shift in a central region of a selected range of frequencies; and actuator means, responsive to said control signal, for actuating said car.

31. A method for reducing horizontal acceleration of an elevator cab, comprising the steps of sensing said acceleration, providing a sensed acceleration signal having a magnitude indicative thereof, providing a counteraction signal having a magnitude and phase selected according to said magnitude of said sensed acceleration signal, wherein said phase of said counteraction signal is selected according to a compensation function having minimum phase shift in a central region between a first selected frequency ($\omega_1$) and a second selected frequency ($\omega_2$).

32. The method of claim 31, wherein said first selected frequency is less than 0.1 Hertz.

33. The method of claim 31, wherein said second selected frequency is greater than six Hertz.

34. The apparatus of claim 28, wherein said magnitude of said counterforce is selected according to a compensation function having negative gain (dB) or less than unity gain below a first selected frequency $\omega_1$ and also above a second selected frequency $\omega_2$ and positive gain (dB) or gain greater than unity in between.

35. The apparatus of claim 28, wherein said first selected frequency is less than two Hertz.

36. The apparatus of claim 28, wherein said second selected frequency is less than ten Hertz.

37. The apparatus of claim 28, wherein said function provides increasing (absolute value) phase shift at frequencies above said central region.

* * * * *